US012624490B2

(12) United States Patent
Lee et al.

(10) Patent No.: US 12,624,490 B2
(45) Date of Patent: May 12, 2026

(54) DETERGENT SUPPLY DEVICE AND CLOTHES TREATING APPARATUS

(71) Applicant: SAMSUNG ELECTRONICS CO., LTD., Suwon-si (KR)

(72) Inventors: Hyounyoung Lee, Suwon-si (KR); Bongjin Ko, Suwon-si (KR); Younghyun Kim, Suwon-si (KR); Junho Kim, Suwon-si (KR); Seulgi Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 444 days.

(21) Appl. No.: 18/094,651

(22) Filed: Jan. 9, 2023

(65) Prior Publication Data

US 2023/0295860 A1 Sep. 21, 2023

Related U.S. Application Data

(63) Continuation of application No. PCT/KR2022/019694, filed on Dec. 6, 2022.

(30) Foreign Application Priority Data

Mar. 15, 2022 (KR) ..... 10-2022-0031930

(51) Int. Cl.
*D06F 39/02* (2006.01)
*D06F 34/14* (2020.01)
*D06F 33/30* (2020.01)

(52) U.S. Cl.
CPC ..... *D06F 39/02* (2013.01); *D06F 34/14* (2020.02); *D06F 33/30* (2020.02)

(58) Field of Classification Search
CPC ..... A47L 15/4263; D06F 39/02; D06F 39/022
See application file for complete search history.

(56) References Cited

U.S. PATENT DOCUMENTS 9,945,065 B2 4/2018 Nam et al.
10,844,635 B2 11/2020 Olson
(Continued)

FOREIGN PATENT DOCUMENTS

CN 107119422 A 9/2017
CN 107177961 A * 9/2017 ..... D06F 39/022
(Continued)

OTHER PUBLICATIONS

Machine translation of KR20050041504A , dated May 4, 2005. (Year: 2005).*
(Continued)

*Primary Examiner* — Michael E Barr
*Assistant Examiner* — Kevin G Lee
(74) *Attorney, Agent, or Firm* — STAAS & HALSEY LLP

(57) ABSTRACT

A clothes treating apparatus including a main body; a tub arranged inside the main body; a detergent container configured to store detergent; a detergent container housing configured to accommodate the detergent container; a pump connected to the detergent container housing so as to discharge the detergent stored in the detergent container; a latch device configured to detachably connect the detergent container to the detergent container housing so as to close the detergent container, and to disconnect the detergent container from the detergent housing so as to open the detergent container; and a controller configured to control the latch device to disconnect the detergent container from the detergent container housing so as to open the detergent container in response to a completion of a washing operation.

12 Claims, 16 Drawing Sheets

(56) References Cited

U.S. PATENT DOCUMENTS

| | | | | |
|---|---|---|---|---|
| 11,661,697 | B2 | 5/2023 | Kim et al. | |
| 2011/0154865 | A1 | 6/2011 | Lee et al. | |
| 2016/0186370 | A1 * | 6/2016 | Kim | D06F 39/02 68/17 R |

FOREIGN PATENT DOCUMENTS

| | | | | | |
|---|---|---|---|---|---|
| CN | 107881704 | A | | 4/2018 | |
| CN | 108677462 | A | * | 10/2018 | D06F 39/02 |
| CN | 109853202 | A | * | 6/2019 | |
| CN | 210886648 | U | * | 6/2020 | |
| KR | 97-6353 | | | 2/1997 | |
| KR | 1997-0006353 | | | 6/1997 | |
| KR | 1999-0028417 | | | 7/1999 | |
| KR | 10-2005-0041504 | A | | 5/2005 | |
| KR | 10-2007-0088914 | | | 8/2007 | |
| KR | 10-0751762 | | | 8/2007 | |
| KR | 10-2008-0107817 | | | 12/2008 | |
| KR | 10-1202753 | B1 | | 11/2012 | |
| KR | 10-2015-0004741 | A | | 1/2015 | |
| KR | 10-2016-0011439 | | | 2/2016 | |
| KR | 10-2016-0148624 | A | | 12/2016 | |
| KR | 10-2017-0004486 | | | 1/2017 | |

OTHER PUBLICATIONS

Machine translation of CN-109853202-A, dated Jun. 7, 2019. (Year: 2019).*

Machine translation of CN-210886648-U, dated Jun. 30, 2020. (Year: 2020).*

Machine translation of CN-108677462-A, dated Oct. 19, 2018. (Year: 2018).*

International Search Report dated Mar. 30, 2023 of International Application No. PCT/KR2022/019694.

Written Opinion of the International Searching Authority dated Mar. 30, 2023 of International Application No. PCT/KR2022/019694.

Extended European Search Report dated Nov. 22, 2024 for European Application No. 22932409.0.

Office Action dated Jul. 22, 2025 issued under Rule 71(3) EPC by the European Patent Office (EPO) for European Application No. 22932409.0.

* cited by examiner

DETERGENT SUPPLY DEVICE AND CLOTHES TREATING APPARATUS

CROSS-REFERENCE TO RELATED APPLICATION(S)

This application is a continuation of International Application PCT/KR2022/019694, filed Dec. 6, 2022, and is based on and claims priority under 35 U.S.C. § 119 to Korean Patent Application No. 10-2022-0031930, filed on Mar. 15, 2022, in the Korean Intellectual Property Office, the disclosures of which are incorporated by reference herein in their entireties

BACKGROUND

1. Field

The disclosure relates to a clothes treating apparatus, and more particularly, to a detergent supply device and a clothes treating apparatus including the same.

2. Description of Related Art

In general, a clothes treating apparatus includes a washing machine in which clothes and detergent put into a rotary tub are rotated by using a driving force of a motor and the clothes are washed by a mutual friction thereof, and a dryer in which a rotary tub receiving an object to be dried is rotated so as to dry the object.

The clothes treating apparatus may include a detergent supply device provided in a cabinet.

The detergent supply device is a device configured to supply detergent to an inside of a tub. The detergent supply device may include a detergent container and a detergent pump docked with the detergent container so as to supply the detergent in the detergent container to the tub.

The detergent supply device of the clothes treating apparatus is convenient because the detergent is automatically supplied by the detergent pump. However, a user cannot notice a lack of detergent although the detergent is insufficient, and thus the user cannot replenish the detergent. Accordingly, the user can start a washing operation in a state in which there is a lack of detergent.

In addition, after the washing operation is completed, the detergent supply device is maintained in a closed state, and thus there is no ventilation, which may cause the growth of mold inside the detergent supply device.

SUMMARY

Aspects of embodiments of the disclosure will be set forth in part in the description which follows and, in part, will be apparent from the description, or may be learned by practice of the presented embodiments.

According to an embodiment of the disclosure, a clothes treating apparatus may include a main body; a tub arranged inside the main body; a detergent container configured to store detergent; a detergent container housing configured to accommodate the detergent container; a pump connected to the detergent container housing so as to discharge the detergent stored in the detergent container; a latch device configured to detachably connect the detergent container to the detergent container housing so as to close the detergent container, and to disconnect the detergent container from the detergent housing so as to open the detergent container; and a controller configured to control the latch device to disconnect the detergent container from the detergent container housing so as to open the detergent container in response to a completion of a washing operation.

According to an embodiment of the disclosure, the controller is configured to control the latch device to disconnect the detergent container from the detergent container housing so as to open the detergent container in response to a lack of detergent in the detergent container.

According to an embodiment of the disclosure, the clothes treating apparatus further includes a sensor configured to detect a remaining amount of detergent or fabric softener in the detergent container, wherein the controller is configured to control the latch device to disconnect the detergent container from the detergent container housing so as to open the detergent container in response to the sensor detecting of a lack of the detergent or fabric softener.

According to an embodiment of the disclosure, the clothes treating apparatus further includes a sensor configured to detect an open and closed state of the detergent container, wherein the controller is configured to control the latch device to disconnect the detergent container from the detergent container housing so as to open the detergent container in response to the sensor detecting a closed state of the detergent container upon the completion of the washing operation.

According to an embodiment of the disclosure, the latch device includes a first latch member arranged on the detergent container; and a second latch member arranged in the detergent container housing, wherein the second latch member is configured to lock the first latch member to, and unlock the first latch member from, the second latch member.

According to an embodiment of the disclosure, the first latch member includes a first latch body in which a locking hole is formed to be locked to, and unlocked from, at least a part of the second latch member.

According to an embodiment of the disclosure, the first latch body includes a pressing member configured to be in contact with at least a part of the second latch member.

According to an embodiment of the disclosure, the second latch member includes a latch unit including a latch configured to be moved to lock the locking hole to lock the first latch member to the second latch member, and to be moved to unlock the locking hole to unlock the first latch member from the second latch member; and a driving unit configured to move the latch.

According to an embodiment of the disclosure, the latch unit includes a latch unit case; a second latch body configured to be moved back and forth inside the latch unit case; an elastic member arranged between the second latch body and the latch unit case and configured to elastically support the second latch body to be movable back and forth; and a guide provided to guide movement of the second latch body, wherein the latch is rotatably coupled to the second latch body.

According to an embodiment of the disclosure, the second latch body includes a rail groove forming a movement path of the guide, wherein the guide is coupled to the rail groove.

According to an embodiment of the disclosure, the second latch member further includes a plate provided to elastically press the guide to be moved along the rail groove in response to back and forth movement of the second latch body.

According to an embodiment of the disclosure, the driving unit includes a motor including a rotation shaft; a gear connected to the rotation shaft of the motor; and a pusher engaged with the gear and configured to convert a rotational motion into a linear motion so as to press and move at least a part of the guide.

According to an embodiment of the disclosure, the pusher is arranged horizontally with the guide.

Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

Figure 1:
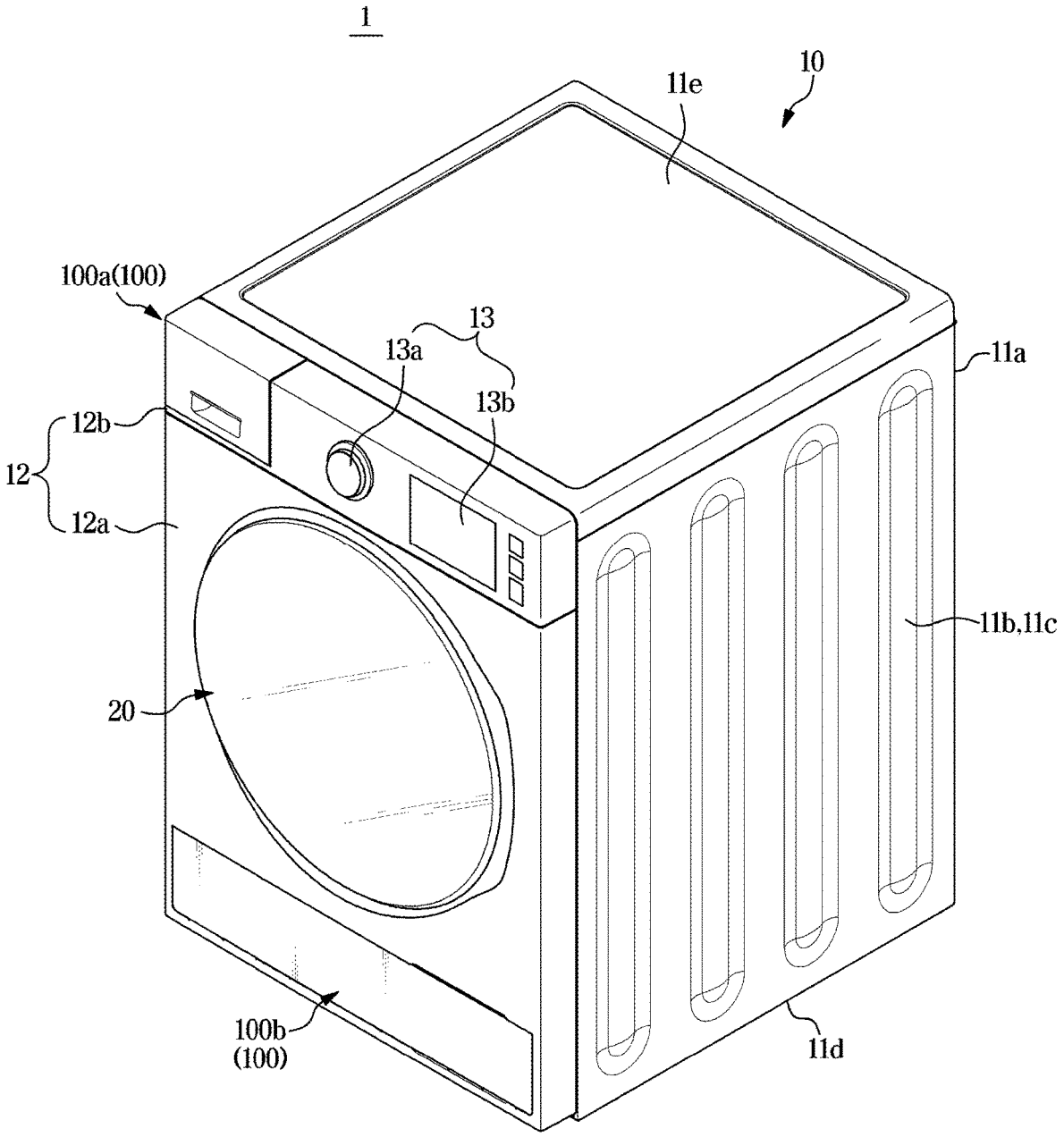
FIG. 1 is a view schematically illustrating a clothes treating apparatus according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter embodiments of the disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

An aspect of the disclosure is to provide a clothes treating apparatus capable of allowing a user to recognize a lack of detergent in a detergent supply device. It is another aspect of the disclosure to provide a clothes treating apparatus capable of preventing contamination and growth of mold by performing ventilation in a detergent supply device. It is another aspect of the disclosure to provide a clothes treating apparatus capable of improving a user convenience.

A clothes treating apparatus 1 according to various embodiments of the disclosure may include a washing machine, a clothes dryer, and a clothes management apparatus. However, for convenience of description, an embodiment of the disclosure will be described with reference to a front-loading washing machine 1.

In addition, detergent may include not only laundry detergent, but also softener, a deodorant, a sterilizing agent, or an air freshener for a clothes dryer.

Reference will now be made in detail to embodiments of the disclosure, examples of which are illustrated in the accompanying drawings.

Figure 2:
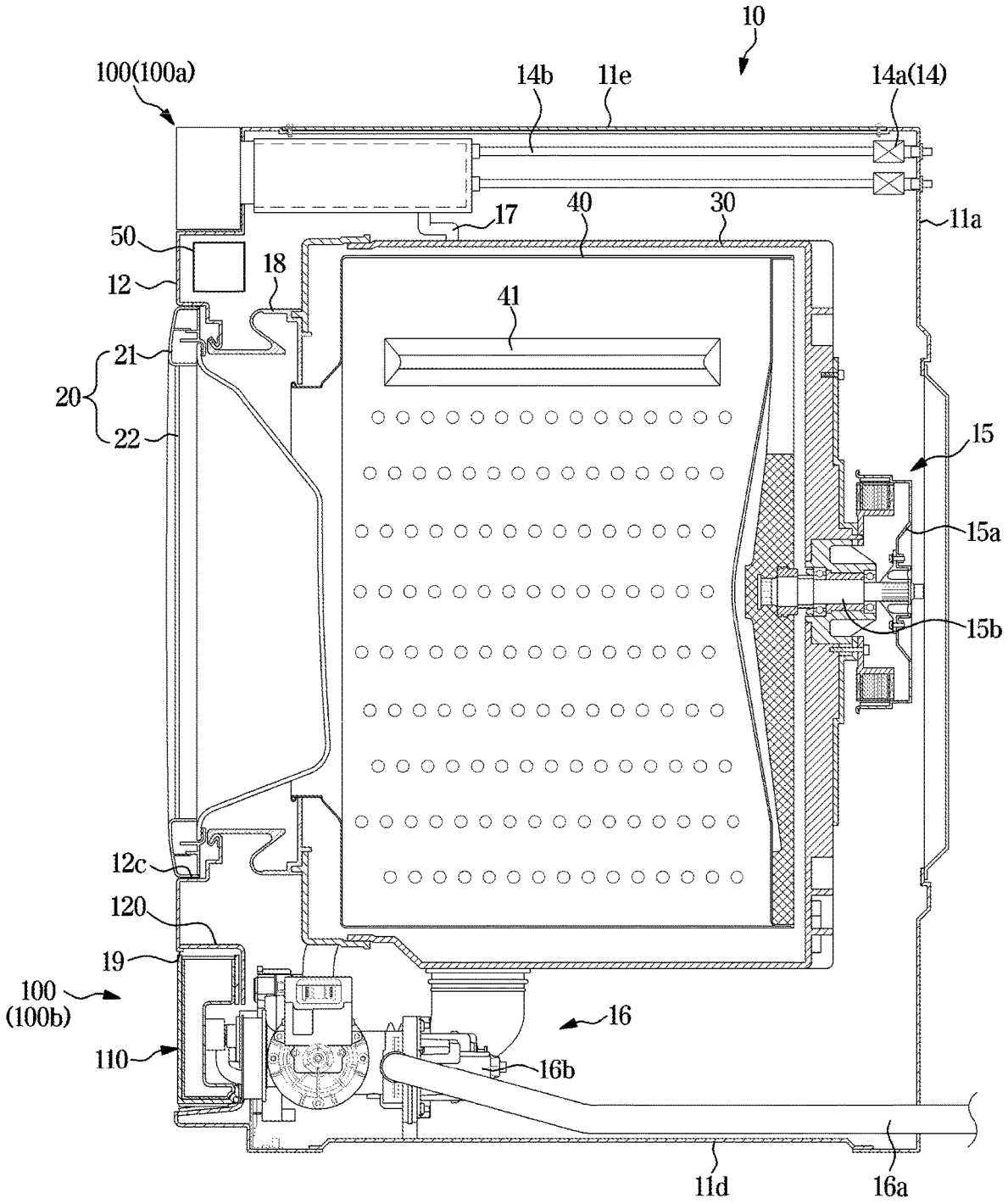
FIG. 2 is a side cross-sectional view illustrating the clothes treating apparatus shown in FIG. 1 according to an embodiment of the disclosure.

FIG. 1 is a view schematically illustrating a clothes treating apparatus according to an embodiment of the disclosure, and FIG. 2 is a side cross-sectional view illustrating the clothes treating apparatus shown in FIG. 1.

As illustrated in FIGS. 1 and 2, a washing machine 1 may include a main body 10 forming an exterior thereof, a tub 30 provided inside the main body 10, a drum 40 arranged inside the tub 30 to accommodate laundry and configured to be rotated, and a driving device 15 configured to rotate the drum 40.

The main body 10 may be provided in a substantially hexahedral shape. The main body 10 may be provided in a box shape with an open front. The main body 10 may include a rear plate 11*a* and both side plates 11*b* and 11*c* being bent forward and extending from the rear plate 11*a*. The main body 10 may include a top cover 11*e* forming an upper surface and a base 11*d* forming a lower surface. The main body 10 may include a front panel 12 provided in an open front portion.

The front panel 12 may include a first panel 12*a* and a second panel 12*b* arranged above the first panel 12*a*. The first panel 12*a* may be arranged in front of the drum 40. The first panel 12*a* may be arranged below the second panel 12*b*. An opening 12*c* may be formed in the first panel 12*a* to put laundry into the drum 40. The opening 12*c* of the first panel 12*a* may be formed to allow laundry to be inserted into or withdrawn from the front of the main body 10. The opening 12*c* of the first panel 12*a* may be opened and closed by a door 20.

The door 20 may include a door frame 21 and a door glass 22. The door glass 22 may be formed of a transparent tempered glass material to allow a user to see the inside of the main body 10.

The second panel 12*b* may be provided on a front upper side of the main body 10. The second panel 12*b* may be arranged above the first panel 12*a*. The second panel 12*b* may be provided to be coupled to the top cover 11*e*.

The second panel 12*b* may be provided with a control panel 13 including an inputter 13*a* configured to receive an operation command from a user and a display 13*b* provided to display operation information of the washing machine 1. The inputter 13*a* may be provided in the form of a rotatable jog dial. However, the disclosure is not limited thereto, and may include various types of inputters and displays.

A user command may be input through the control panel 13. In response to various washing-related modes being selected by a user through the inputter 13*a*, the control panel 13 may transmit a control signal corresponding thereto to a controller 50.

The controller 50 may include a memory (not shown) configured to memorize a program and data for controlling the operation of the washing machine 1 and a processor (not shown) configured to generate a control signal for controlling the operation of the washing machine 1 according to the program and data memorized in the memory.

The controller 50 may identify a state of the washing machine 1 through various sensors 61 and 62 (shown in FIG. 4) installed in the washing machine 1, and may generate a control signal. A detailed description of the sensors 61 and 62 will be described later.

At a rear of the tub 30, the driving device 15 may rotate the drum 40 forward and reverse so as to allow the drum 40 to perform wash, rinse, spin-dry, and dry cycles.

The driving device 15 may be provided at a rear of the drum 40. The driving device 15 may be configured to rotate the drum 40 by transmitting a driving force generated by a driving motor 15*a* to a driving shaft 15*b*. The driving motor 15*a* may be provided with a fixed stator and a rotor configured to be rotated by electromagnetic interaction with the stator, and thus the driving motor 15*a* may convert an electric force into a mechanical-rotational force. However, the components of the motor are not limited to the above example.

The drum 40 may perform the washing operation by raising and dropping laundry while being rotated inside the tub 30. A plurality of lifters 41 may be provided inside the drum 40.

The tub 30 may be formed in a substantially cylindrical shape. The tub 30 may be provided to store mixed water in which washing water and detergent are mixed. The tub 30 may be fixed inside the main body 10. The opening 12*c* of the front panel 12 may be connected to the tub 30 by a diaphragm 18. The diaphragm 18 may be provided to seal a space between the front panel 12 and the tub 30.

A water supply device 14 may be provided above the tub 30. The water supply device 14 may include a water supply valve 14*a* configured to control water supply, and a water supply pipe 14*b* connected to the water supply valve 14*a*. The water supply device 14 may be configured to supply water to the tub 30.

A drain device 16 including a drain pipe 16*a*, a drain valve (not shown), and a drain pump 16*b* that are configured to drain water of the tub 30 may be arranged under the tub 30.

The washing machine according to an embodiment of the disclosure may include a detergent supply device 100. The detergent supply device 100 may be configured to supply detergent into the tub.

The detergent supply device 100 may be provided in plurality. The detergent supply device 100 may include a first detergent supply device 100*a* and a second detergent supply device 100*b*.

The first detergent supply device 100*a* may be arranged above the tub 30. The first detergent supply device 100*a* may be arranged at an inner upper end of the main body 10. The first detergent supply device 100*a* may be arranged on the front panel 12. The first detergent supply device 100*a* may be arranged on the second panel 12*b* of the front panel 12. At the upper portion of the front panel 12, the first detergent supply device 100*a* may be configured to be inserted into or withdrawn from the main body 10. The first detergent supply device 100*a* may be configured to slide. The first detergent supply device 100*a* may allow detergent to flow into the tub 30. The first detergent supply device 100*a* may be connected to the water supply device 14. The first detergent supply device 100*a* may allow detergent to flow into the tub 30 together with washing water introduced through the water supply device 14. The first detergent supply device 100*a* may be provided above the tub 30 to supply detergent to the inside of the tub 30 during a water supply process. For example, the first detergent supply device 100*a* may allow solid laundry detergent and/or fabric softener to be moved into the tub 30. However, the type of detergent is not limited to the above example.

Water that is introduced into the inside of the washing machine 1 through the water supply device 14 connected to an external waster supply source (not shown) may be supplied to the tub 30 through the first detergent supply device 100*a*. The first detergent supply device 100*a* may be connected to the tub 30 through a water supply pipe 17. The washing water supplied through the water supply pipe 17 of the water supply device 14 may be mixed with the detergent while passing through the first detergent supply device 100*a*, and the mixed water in which the washing water is mixed with the detergent may be supplied to the tub 30.

The second detergent supply device 100*b* may be arranged in a lower portion of the main body 10. The second detergent supply device 100*b* may be arranged under the tub 30. For example, the second detergent supply device 100*b* may be arranged on an inner lower side of the main body 10. At the lower portion of the front panel 12, the second detergent supply device 100*b* may be configured to be inserted into or withdrawn from the main body 10. The second detergent supply device 100*b* may be provided to allow detergent to flow into the tub 30. The second detergent supply device 100*b* may allow liquid laundry detergent and/or fabric softener to flow into the tub 30. However, the type of detergent is not limited to the above example. A detailed description of the second detergent supply device 100*b* will be described later.

Figure 3:
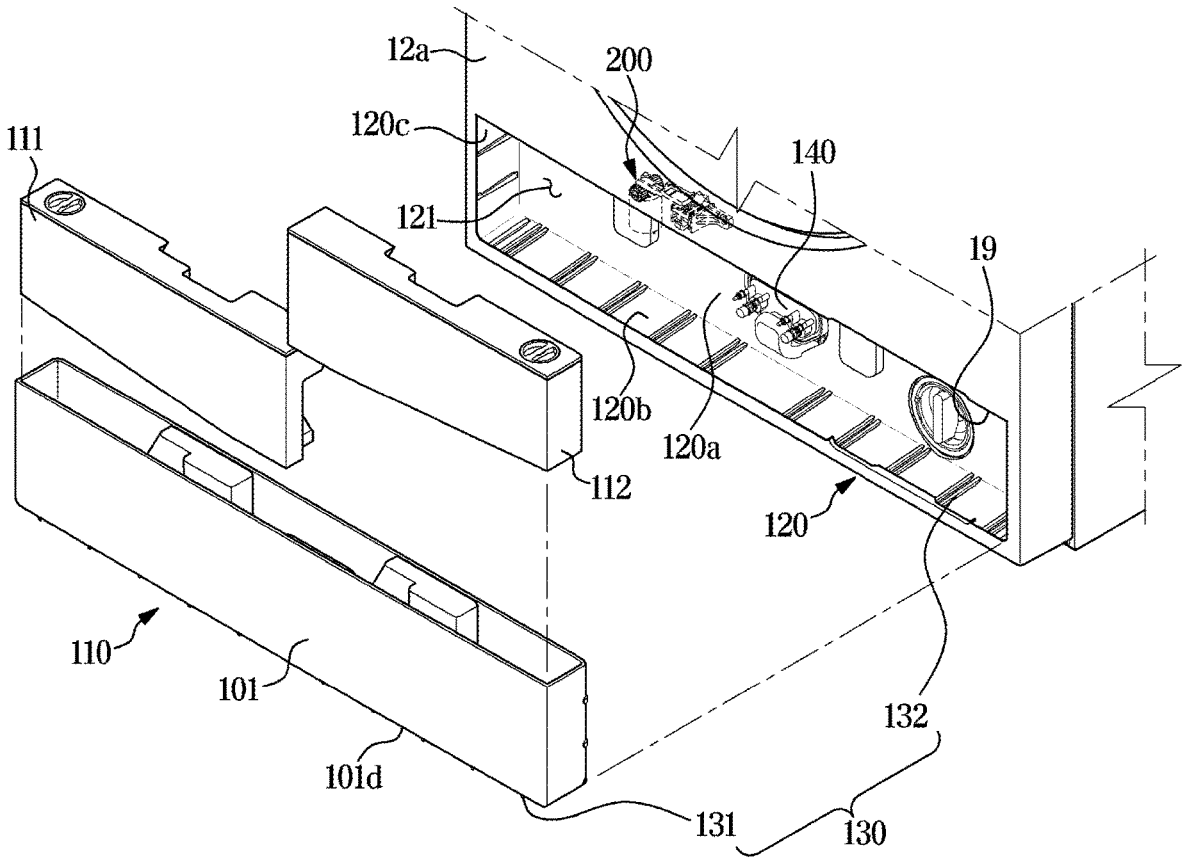
FIG. 3 is a partially-exploded perspective view illustrating a detergent supply device of the clothes treating apparatus shown in FIG. 1 according to an embodiment of the disclosure.
Figure 4:
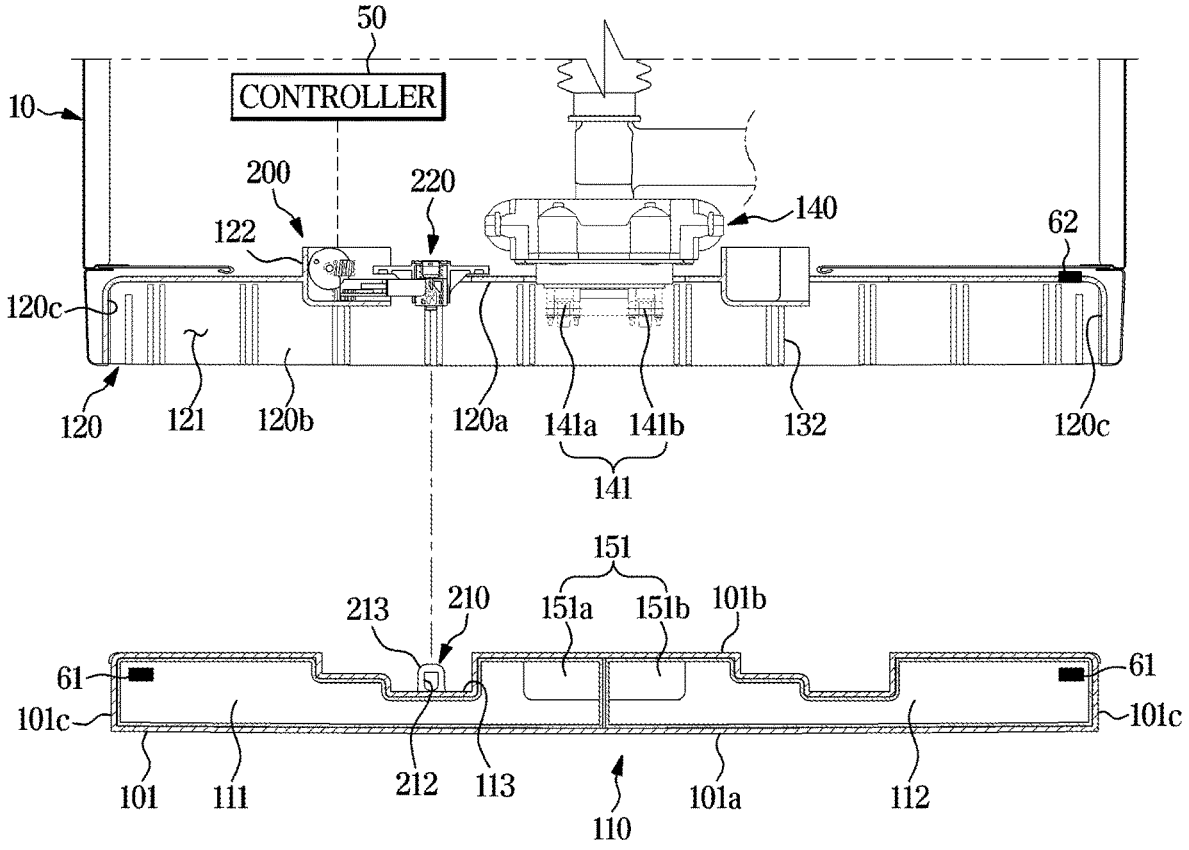
FIG. 4 is a view illustrating a state in which a latch device is mounted to the detergent supply device in the clothes treating apparatus shown in FIG. 2 according to an embodiment of the disclosure.
Figure 5:
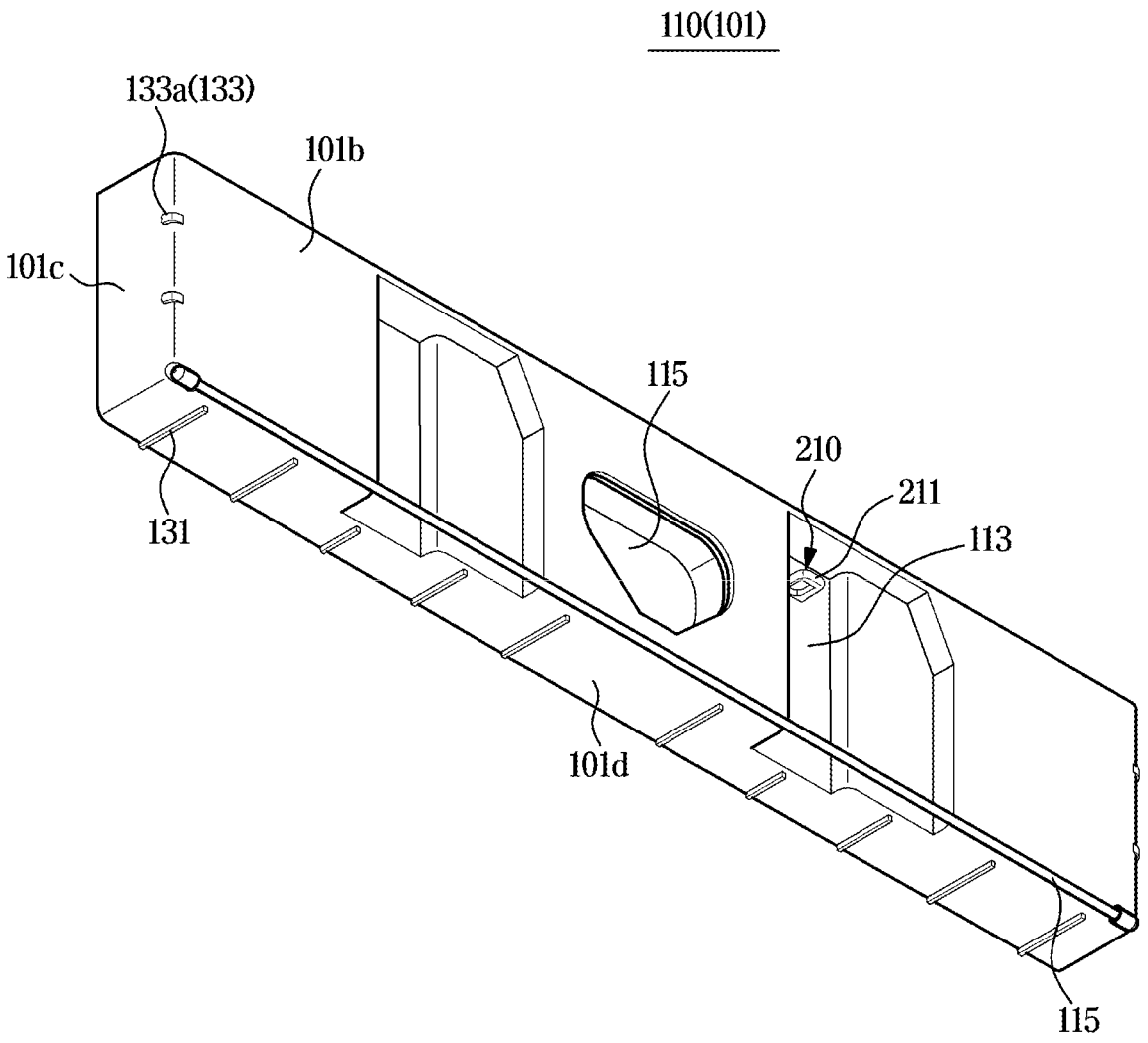
FIG. 5 is a perspective view schematically illustrating a detergent container of the detergent supply device shown in FIG. 4 according to an embodiment of the disclosure.

FIG. 3 is a partially-exploded perspective view illustrating a detergent supply device of the clothes treating apparatus shown in FIG. 1, FIG. 4 is a view illustrating a state in which a latch device is mounted to the detergent supply device in the clothes treating apparatus shown in FIG. 2, and FIG. 5 is a perspective view schematically illustrating a detergent container of the detergent supply device shown in FIG. 4.

As illustrated in FIGS. 3 to 5, the second detergent supply device 100*b* (hereinafter, referred to as a 'detergent supply device') may be arranged at the lower front portion of the main body 10. The detergent supply device 100 may be installed at an inner front lower end of the main body 10.

The detergent supply device 100*b* may include a detergent container 110 and a detergent container housing 120. The detergent container 110 may be detachably provided in the detergent container housing 120. The detergent container 110 may be provided to slide on the detergent container housing 120.

The detergent container 110 may be provided to accommodate laundry detergent and fabric conditioner and/or fabric softener therein. The detergent container 110 may include a first detergent container 111 provided to accommodate laundry detergent therein. The detergent container 110 may include a second detergent container 112 provided to accommodate a fabric conditioner and/or fabric softener.

The detergent container 110 may be provided to be accommodated in a detergent container box 101. The first detergent container 111 and the second detergent container 112 may be accommodated in the detergent container box 101 including an open upper surface. The detergent container box 101 may be provided in a rectangular parallelepiped shape. The detergent container box 101 may be provided to accommodate the first detergent container 111 and the second detergent container 112. The first detergent container 111 and the second detergent container 112 may be separately accommodated in the detergent container box 101, respectively. The first detergent container 111 and the second detergent container 112 may be accommodated side by side in the detergent container box 101 and the first detergent container 111 and the second detergent container 112 may be provided to be simultaneously removed from the main body 10. The first detergent container 111 and the second detergent container 112 may be accommodated in the detergent container box 101 and slide from the main body 10. In an embodiment of the disclosure, the detergent container is illustrated as being accommodated in the detergent container box, but is not limited thereto. For example, the detergent container and the detergent container box may be provided integrally with each other.

The detergent container 110 or the detergent container box 101 may further include a first sensor 61 configured to detect a remaining amount of detergent and/or fabric softener in the detergent container 110. The first sensor 61 may be arranged inside the first detergent container 111 and the second detergent container 112. The first sensor 61 may be arranged on at least a portion of the detergent container box 101.

The detergent container housing 120 may be arranged in the lower portion of the front panel 12 of the main body 10. The detergent container housing 120 may be provided in a hexahedral shape with an open front surface. The detergent container housing 120 may be provided in a shape corresponding to the detergent container 110 to accommodate the detergent container 110. The detergent container housing 120 may be provided in a shape corresponding to the detergent container box 101 to allow the detergent container box 101, in which the detergent container 110 is accommodated, to be mounted thereon. The detergent container housing 120 may include a detergent container receiving member 121 provided to accommodate the detergent container box 101.

The detergent container box 101 may be slidably mounted to the detergent container housing 120 through the opened front surface. The detergent container housing 120 may be provided such that the detergent container box 101 is slidably coupled in a front and rear direction of the main body 10 through the opened front surface.

The detergent container housing 120 and the detergent container box 101 may slidably coupled through a guide rib 130. The guide rib 130 may include a first guide rib 131 provided in the detergent container box 101 and a second guide rib 132 provided in the detergent container housing 120. The first guide rib 131 and the second guide rib 132 may be provided at positions corresponding to each other. The first guide rib 131 may be provided on a lower surface 101*d* of the detergent container box 101 in the front and rear direction. The second guide rib 132 may be provided on an inner lower surface of the detergent container housing 120 in the front and rear direction. The first guide rib 131 may be coupled to the second guide rib 132 to move the detergent container box 101 in the front and rear direction.

The detergent container box 101 may be formed in a substantially rectangular parallelepiped shape. The detergent container box 101 may be provided with an open upper surface to allow the detergent container 110 to be inserted and mounted thereon.

The detergent container box 101 may include a detergent container box front surface 101*a* forming the front surface of the washing machine 1, a detergent container box rear surface 101*b* formed to face the detergent container box front surface 101*a*, a pair of detergent container box side surfaces 101*c* connecting the detergent container box front surface 101*a* to the detergent container box rear surface 101*b*, and the detergent container box lower surface 101*d* formed to face the open upper surface of the detergent container box 101. The first guide rib 131 may be arranged on the detergent container box lower surface 101*d*.

The detergent container housing 120 is provided with an open front surface to allow the detergent container 110 to be accommodated therein. The detergent container housing 120 may include the detergent container receiving member 121 provided to correspond to the detergent container box 101. The detergent container receiving member 121 may be formed in a size and shape corresponding to the detergent container box 101 so as to accommodate the detergent container box 101. The detergent container receiving member 121 may include an upper surface 120*d*, a lower surface 120*b*, a rear surface 120*a*, and both side surfaces 120*c* that form the detergent container housing 120. The detergent container receiving member 121 may be formed therein by the upper surface 120*d*, the lower surface 120*b*, the rear surface 120*a*, and both side surfaces 120*c* of the detergent container housing 120. The second guide rib 132 may be arranged on the lower surface 120*b*.

The detergent container housing 120 may be installed at a front lower end of the washing machine 1. The detergent container housing 120 may be installed in the lower portion of the front panel 12. The detergent container housing 120 may be installed at the lower end of the first panel 12*a*. The detergent container housing 120 may be mounted on a detergent container installation port 19 formed in the first panel 12*a*. The detergent container housing 120 may be inserted into the detergent container installation port 19 and provided inside the main body 10. In an embodiment of the disclosure, the detergent container housing is illustrated as being separately provided and mounted on the front panel, but is not limited thereto. For example, the detergent container housing may be integrally formed with the front panel.

A second sensor 62 configured to detect an open state of the detergent container 110 may be provided in the detergent container 110 or the detergent container housing 120. The second sensor 62 may be arranged in the detergent container box 101 or the detergent container housing 120. The second sensor 62 may be provided to detect whether the detergent container 110 is opened or closed from the detergent container housing 120. The second sensor 62 may be arranged on at least a portion of the main body 10 or the front panel 12.

In addition, in an embodiment of the disclosure, the detergent container receiving member is illustrated as having a rectangular parallelepiped shape with an open front surface, but is not limited thereto. For example, the detergent container housing may be provided to include only both side surfaces and a lower surface.

The detergent supply device 100 may further include a pump 140 connected to a circulation device (not shown) to supply detergent to the tub 30. The detergent and softener inside the detergent container 110 may be pumped by the pump 140 arranged outside the detergent container 110, and the pumped detergent and softener may be supplied into the drum 40. The pump 140 may be configured to suck detergent from the detergent container 110 in response to being docked with the detergent container 110. The pump 140 may be provided inside the main body 10 of the washing machine 1. The pump 140 may be provided in the detergent container housing 120 to allow the detergent container 110 to be docked therewith. The pump 140 may be arranged on the rear surface 120*a* of the detergent container housing 120. The pump 140 may be connected to the detergent container 110 accommodated in the detergent container housing 120, so as to suck detergent and softener from the detergent container 110.

The pump 140 may include a connection member 141 connected to the detergent container 110. The pump 140 may include a first connection member 141*a* connected to the first detergent container 111 and a second connection member 141*b* connected to the second detergent container 112.

A pump connection member corresponding to the pump 140 may be provided in the detergent container box 101 in which the detergent container 110 is accommodated. The pump connection member may include a first pump connection member connected to the first connection member 141*a* and a second pump connection member connected to the second connection member 141*b*.

In response to the detergent container box 101 being mounted to the detergent container housing 120, the pump connection member 141 of the detergent container 110 may be respectively connected to the connection member 141 of the pump 140.

The detergent container 110 may be mounted by sliding on the detergent container housing 120. The detergent container 110 in a state of being accommodated in the detergent container box 101 may be provided to slide on the detergent container housing 120.

The detergent container 110 may further include a roller 115 for smoothing a movement from the detergent container housing 120. The roller 115 may be arranged in the detergent container box 101. The roller 115 may be arranged at a rear end of the detergent container box lower surface 101*d*. The roller 115 may be rotatably mounted to facilitate the movement when the detergent container 110 is moved from the detergent container housing 120.

The detergent container 110 may be detachably connected to the detergent container housing 120. The detergent container 110 may be detachably connected to the detergent container housing 120 through a latch device 200. The latch device 200 may be configured to allow the detergent container 110 to be locked to and/or unlocked from the detergent container housing 120.

The latch device 200 may be configured to open the detergent container 110. The latch device 200 may be controlled by the controller 50. The latch device 200 may be controlled to open the detergent container 110 in response to a lack of detergent in the detergent container 110. The latch device 200 may be controlled by the controller 50, so as to open the detergent container 110 from the detergent container housing 120 in response to a lack of detergent and/or fabric softener detected by the first sensor 61.

The latch device 200 may detect a state of the detergent container 110 by the second sensor 62 so as be controlled to open the detergent container 110 from the detergent container housing 120 by the controller 50.

The latch device 200 may include a first latch member 210 arranged in the detergent container 110 and a second latch member 220 arranged in the detergent container housing 120.

The first latch member 210 may be provided in the detergent container 110. The first latch member 210 may be provided in the detergent container box 101. The first latch member 210 may be provided on the detergent container box rear surface 101*b*.

The first latch member 210 may be provided to protrude rearward from the detergent container box rear surface 101*b*. The second latch member 220 may be arranged at a position corresponding to the first latch member 210. The second latch member 220 may be provided on the main body 10. The second latch member 220 may be provided in the detergent container housing 120. A first latch member installation member 113 for installing the first latch member 210 may be provided in the detergent container box 101. The first latch member installation member 113 may be formed in such a way that at least a portion of the detergent container box rear surface 101*b* is recessed.

The second latch member 220 may be configured to lock or unlock the first latch member 210. The second latch member 220 may be controlled by the controller 50. A second latch member installation member 122 for installing the second latch member 220 may be provided in the detergent container housing 120. At least a portion of the second latch member 220 may be connected to the controller 50.

Figure 6:
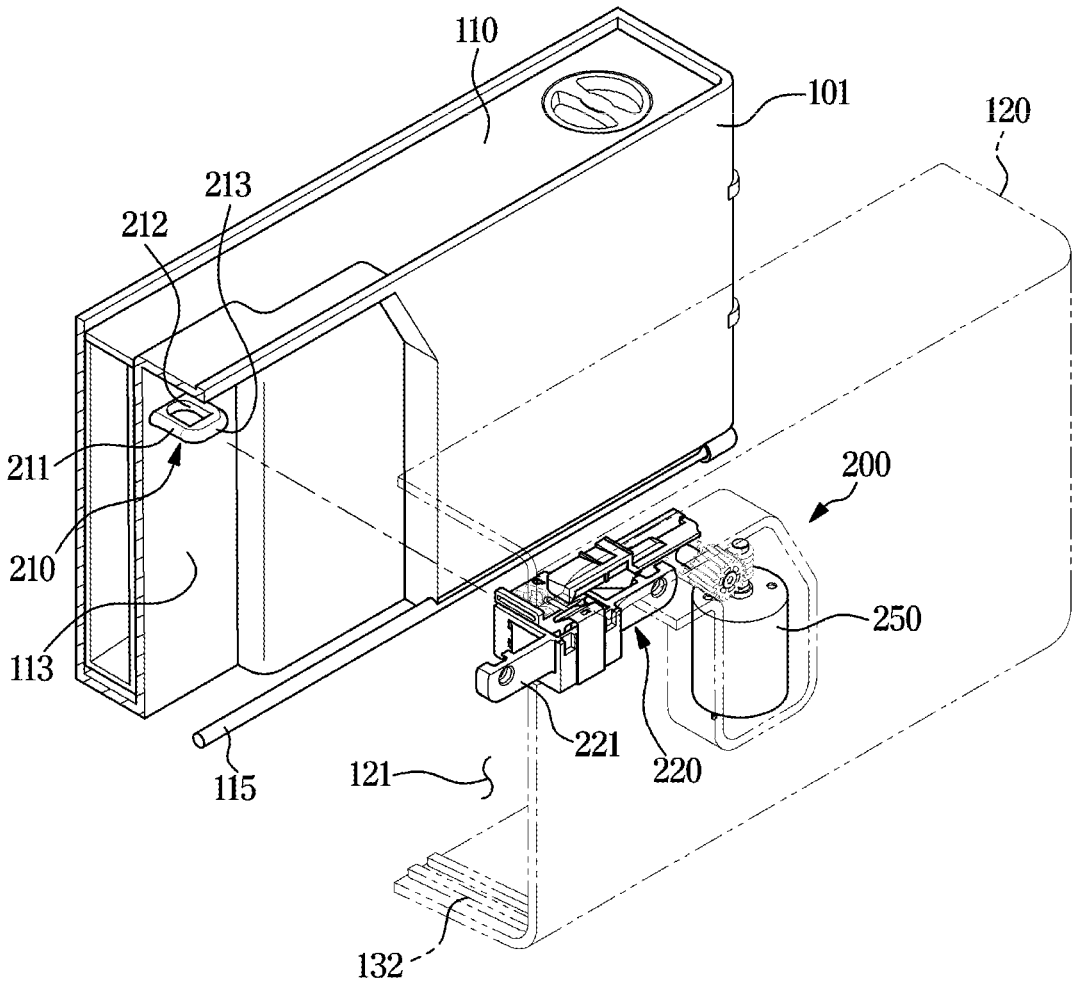
FIG. 6 is a partially-exploded perspective view illustrating the latch device of the detergent supply device according to an embodiment of the disclosure.
Figure 7:
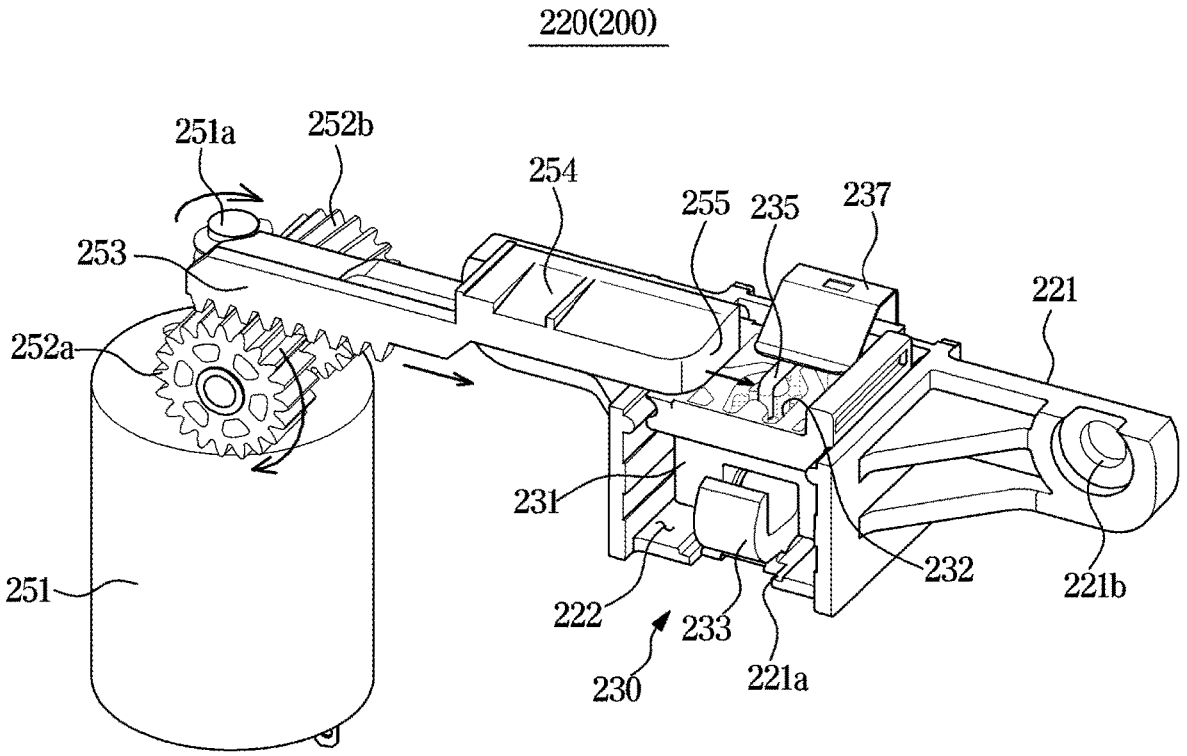
FIG. 7 is a perspective view illustrating a second latch member of the latch device shown in FIG. 6 according to an embodiment of the disclosure.
Figure 8:
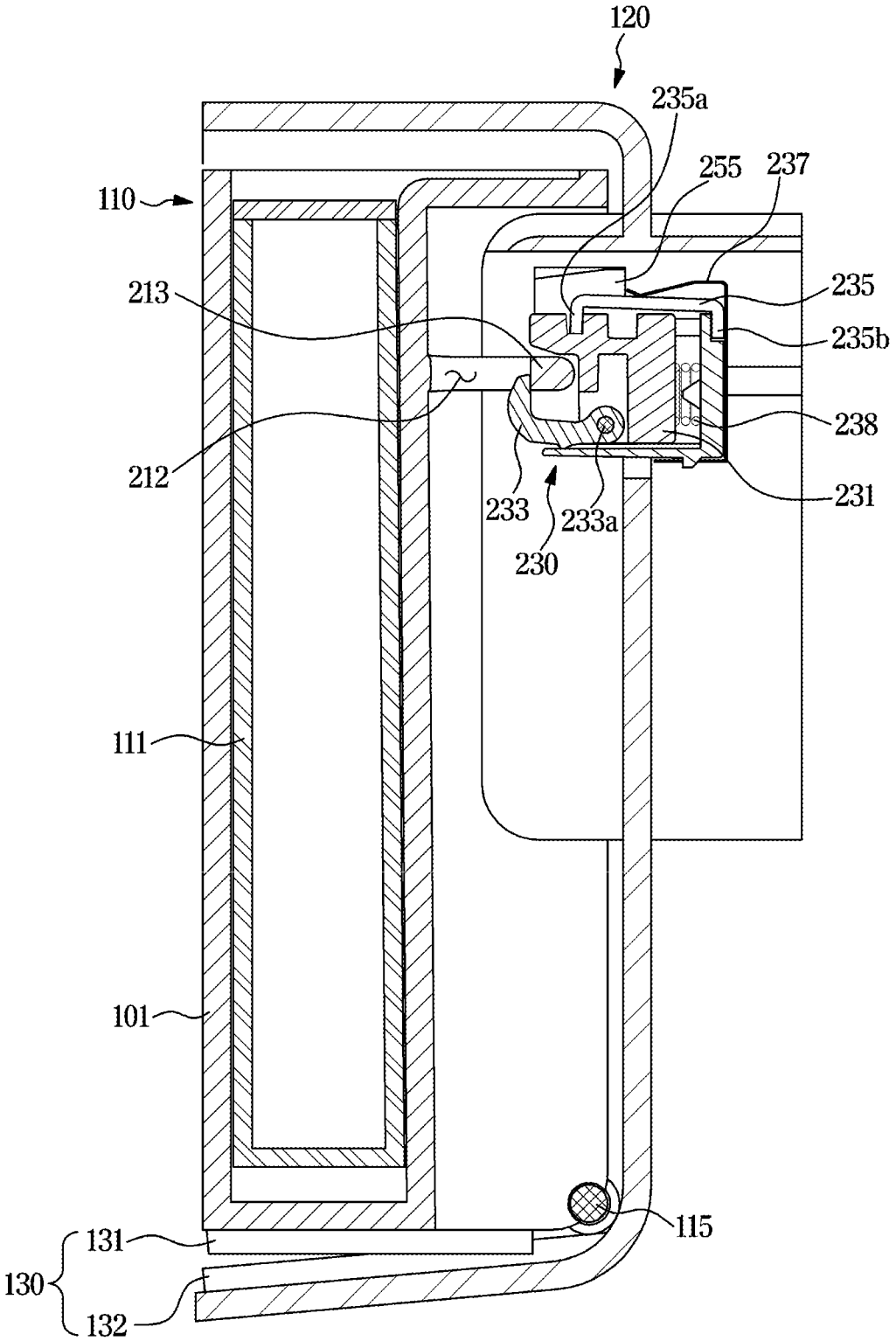
FIG. 8 is a view illustrating a closed state of the detergent container of the detergent supply device according to an embodiment of the disclosure.
Figure 9:
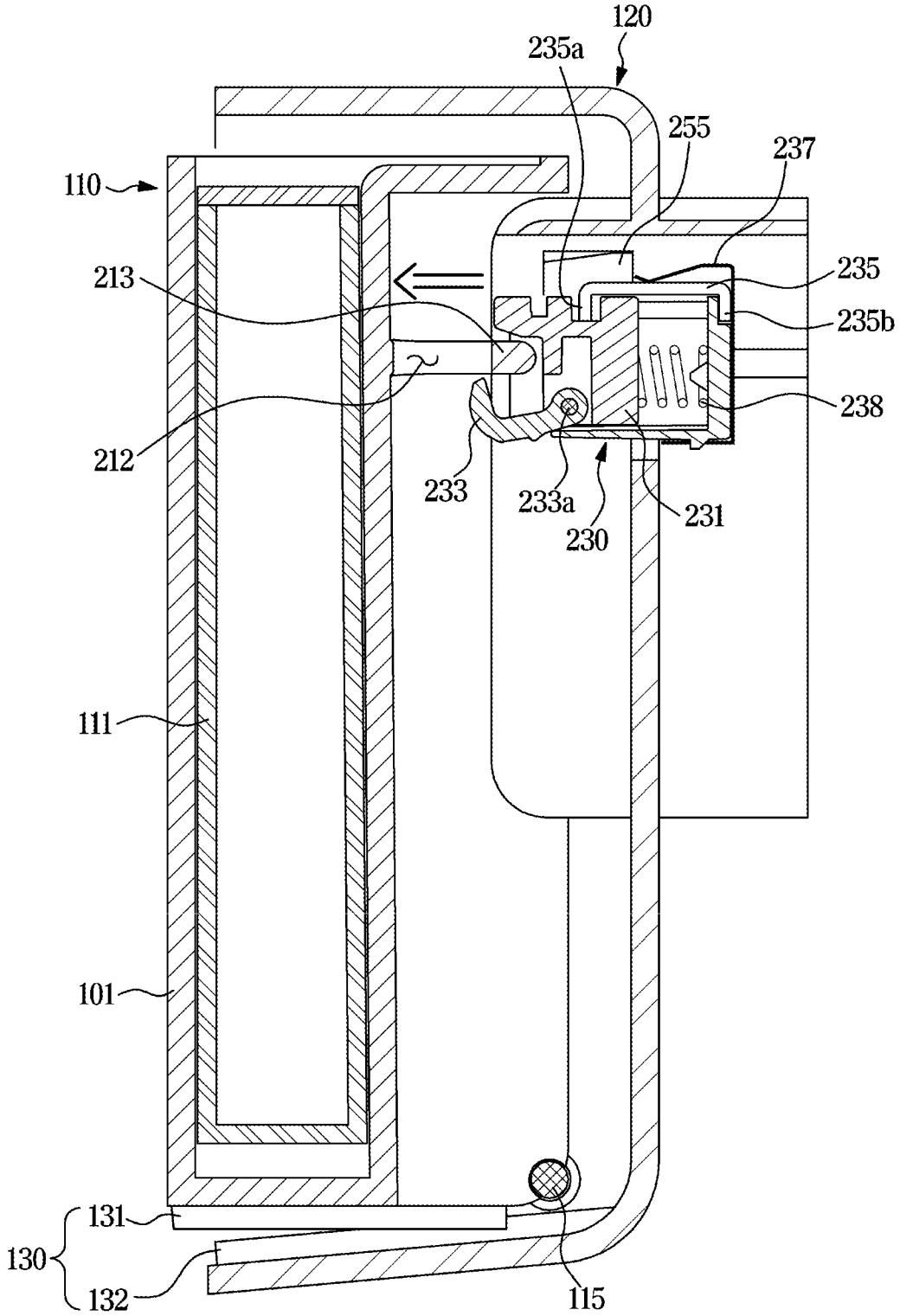
FIG. 9 is a view illustrating an open state of the detergent container of the detergent supply device according to an embodiment of the disclosure.
Figure 10:
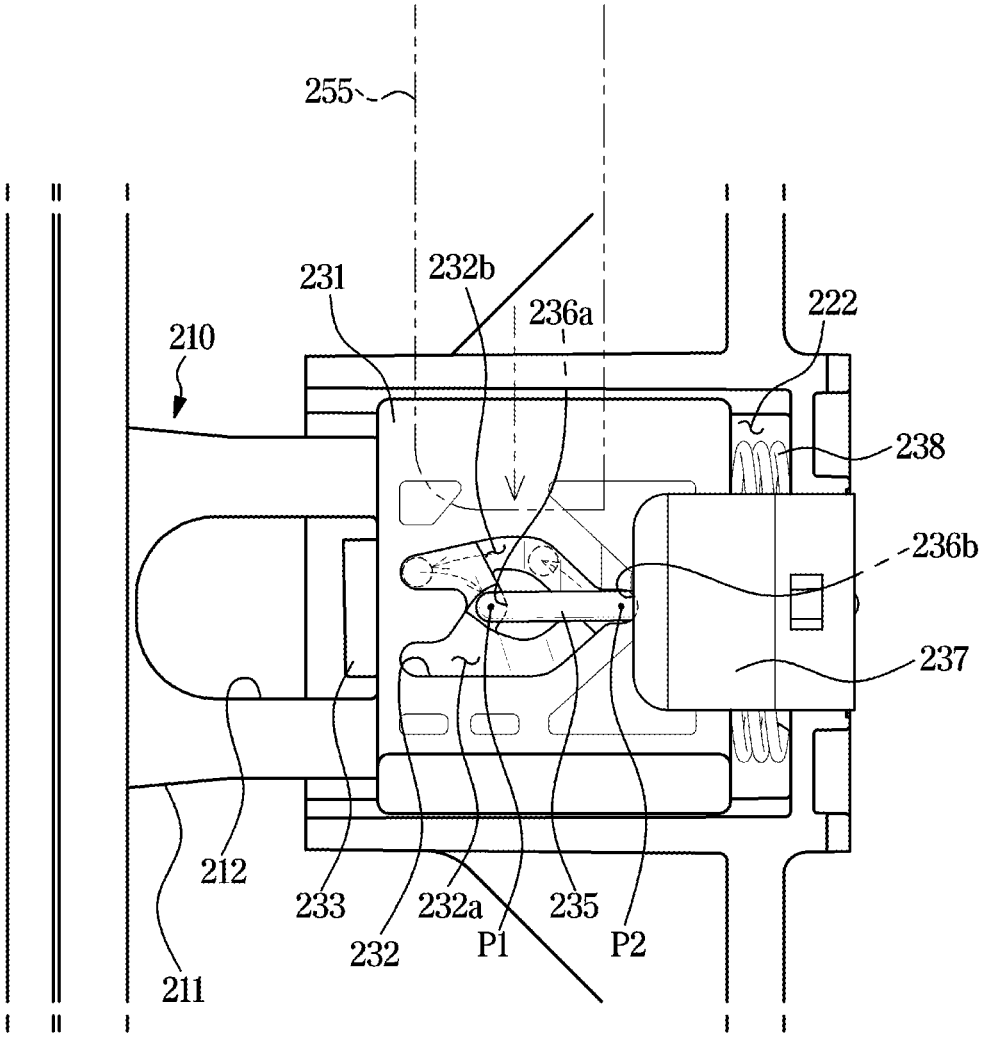
FIG. 10 is a view illustrating a closed state of the latch device shown in FIG. 9 according to an embodiment of the disclosure.
Figure 11:
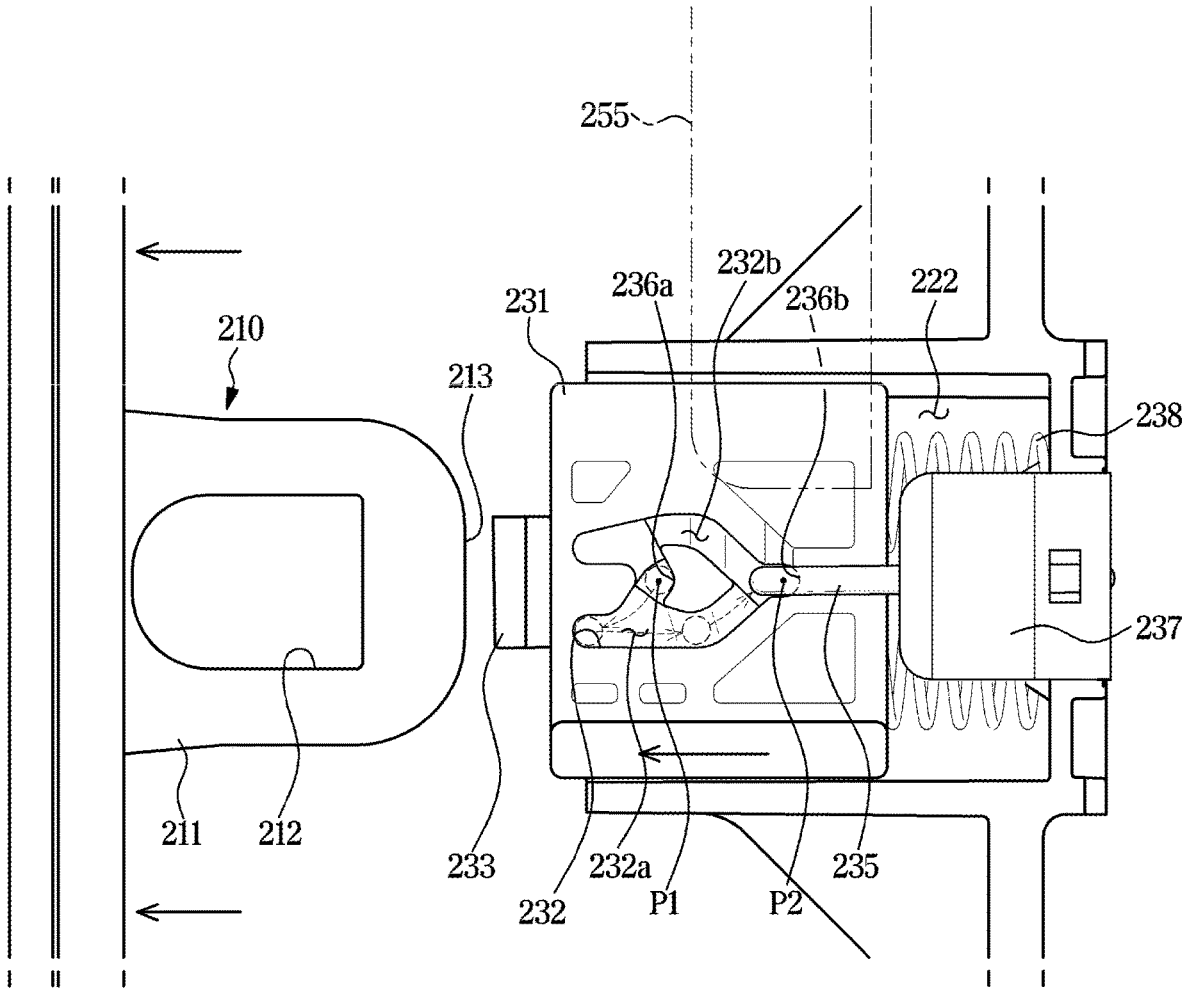
FIG. 11 is a view illustrating an open state of the latch device shown in FIG. 9 according to an embodiment of the disclosure.
Figure 12:
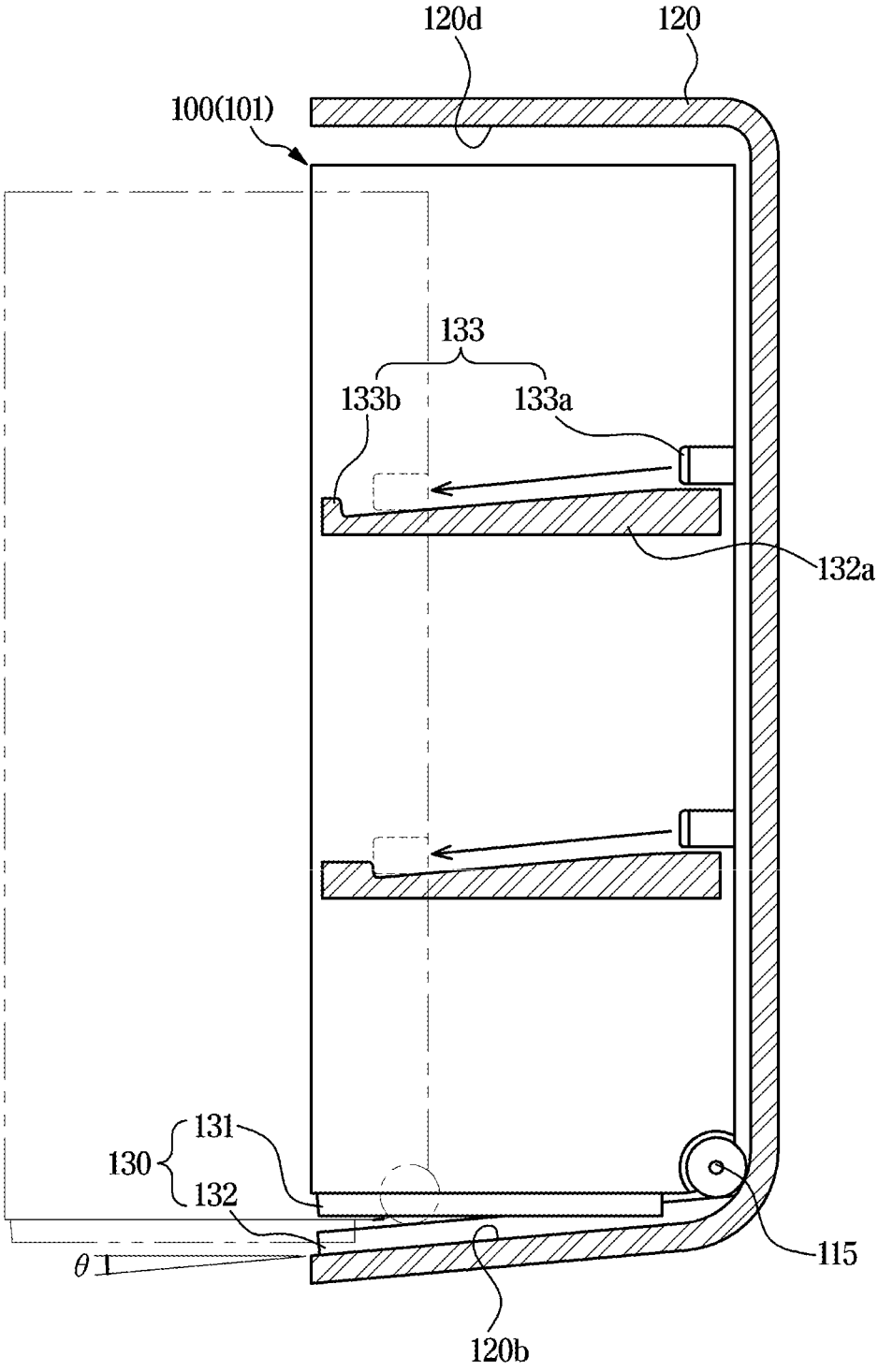
FIG. 12 is a side cross-sectional view illustrating the detergent container of the detergent supply device shown in FIG. 9 according to an embodiment of the disclosure.

FIG. 6 is a partially exploded perspective view illustrating the latch device of the detergent supply device according to an embodiment of the disclosure, FIG. 7 is a perspective view illustrating a second latch member of the latch device shown in FIG. 6, FIG. 8 is a view illustrating a closed state of the detergent container of the detergent supply device according to an embodiment of the disclosure, FIG. 9 is a view illustrating an open state of the detergent container of the detergent supply device according to an embodiment of the disclosure, FIG. 10 is a view illustrating a closed state of the latch device shown in FIG. 9, and FIG. 11 is a view illustrating an open state of the latch device shown in FIG. 9. FIG. 12 is a side cross-sectional view illustrating the detergent container of the detergent supply device shown in FIG. 9.

As illustrated in FIGS. 6 to 12, the detergent container 110 may be arranged at an inner lower portion of the washing machine 1 to be moved back and forth from the detergent container housing 120.

The latch device 200 provided to connect the detergent container 110 to the detergent container housing 120 may be provided to allow the detergent container 110 to be detachable from the detergent container housing 120. Particularly, the latch device 200 may be provided to unlock the detergent container 110 from the detergent container housing 120 so as to open the detergent container 110. The latch device 200 may be configured to open the detergent container 110 from the detergent container housing 120.

The latch device 200 may include the first latch member 210 and the second latch member 220.

The first latch member 210 may be provided in the detergent container box 101. The first latch member 210 may be provided on the detergent container box rear surface 101*b*. The first latch member 210 may be locked to or unlocked from at least a portion of the second latch member 220.

The first latch member 210 may include a first latch body 211 in which a locking hole 212 is formed to be locked to or unlocked from at least a portion of the second latch member 220, and a pressing member 213 formed in the first latch body 211 and in contact with at least a portion of the second latch member 220.

The first latch body 211 may be formed in a rectangular plate shape. The locking hole 212 may be formed in the center of the first latch body 211. The pressing member 213 may be provided at a rear end of the first latch body 211. The pressing member 213 may be provided to press a second latch body 231 of the second latch member 220 to be described later.

According to an embodiment of the disclosure, the first latch body 211 is illustrated as having a rectangular plate shape, but is not limited thereto. For example, the first latch body and/or the locking hole may vary according to the latch of the second latch body.

The second latch member 220 may be provided in the detergent container housing 120. The second latch member 220 may be arranged at a position corresponding to the first latch member 210. The second latch member 220 may include a latch 233 provided to lock or unlock the locking hole 212 of the first latch member 210. The second latch member 220 may include a latch unit 230 including the latch 233 and a driving unit 250 configured to move the latch 233.

The second latch member 220 may include a latch unit case 221. The latch unit 230 may include the latch unit case 221. The latch unit 230 may include the second latch body 231 provided to be moved back and forth inside the latch unit case 221, an elastic member 238 providing elastic support between the second latch body 231 and the latch unit case 221 to allow the second latch body 231 to be moved back and forth, and a guide 235 provided to guide the movement of the second latch body 231.

The latch unit case 221 may be provided to allow the latch unit 230 to be installed to the detergent container housing 120. In the latch unit case 221, a latch unit receiving member 222 may be formed to accommodate the latch unit 230. The latch unit receiving member 222 may be formed to allow at least a portion of the latch unit 230 to be moved back and forth.

At least one fixer 221*b* fixing the second latch member 220 to the detergent container housing 120 may be provided in the latch unit case 221.

The second latch body 231 may be moved back and forth inside the latch unit case 221. The second latch body 231 may be moved back and forth in the latch unit receiving member 222. The second latch body 231 may include a rail groove 232 forming a movement path of the guide 235. One end of the guide 235 may be connected to the rail groove 232 of the second latch body 231, and the other end of the guide 235 may be connected to the latch unit case 221.

The second latch body 231 may be elastically supported by the elastic member 238 inside the latch unit case 221 and thus the second latch body 231 may be elastically supported in the front and rear direction. Due to the elastic support, the second latch body 231 may be moved in the front and rear direction in the latch unit receiving member 222.

A hinge 233*a* may be coupled to the second latch body 231 to allow the latch 233 to be rotatable. The latch 233 may be coupled to the second latch body 231 through the hinge 233*a*. The latch 233 may be coupled to a lower portion of the second latch body 231 through the hinge 233*a*. The latch 233 may be coupled to the second latch body 231 to be vertically rotated forward. The latch 233 may be rotatably coupled in the vertical direction to lock or unlock the locking hole 212 of the first latch member 210. The latch 233 may be provided to hold or release the locking hole 212 of the first latch member 210.

The latch 233 may be rotatably supported by the latch guide 235 provided in the latch unit case 221 receiving the second latch body 231. The latch guide 235 may be formed on a lower surface of the latch unit case 221. Particularly, in response to the forward movement of the second latch body 231, the latch guide 235 may not support a lower portion of the latch 233 to allow the latch 233 to be rotated downward. In response to the rearward movement of the second latch body 231, the latch guide 235 may support the lower portion of the latch 233 to allow the latch 233 to be rotated upward.

The latch 233 rotatably connected to the second latch body 231 may be moved integrally with the second latch body 231 in the front and rear direction, and may be rotated in the vertical direction while being moved in the front and rear direction.

The second latch body 231 may be elastically supported by the elastic member 238 and moved forward. The second latch body 231 may be pressed by the first latch member 210 and moved rearward.

The rail groove 232 forming the movement path of the guide 235 may be provided in the second latch body 231. The rail groove 232 may be formed by being recessed on an upper surface of the second latch body 231. The guide 235 may be coupled to the rail groove 232.

The guide 235 may include a first end 235*a* connected to the rail groove 232 of the second latch body 231 and a second end 235*b* connected to the first end and connected to the latch unit case 221. The first end 235*a* of the guide 235 may be moved along the rail groove 232. The second end 235*b* of the guide 235 may be fixed to the latch unit case 221 but rotatably connected to the latch unit case 221 to allow the first end 235*a* to be moved along the rail groove 232.

The second latch member 220 may further include an elastic plate 237 provided to elastically support the guide 235 to be moved along the rail groove 232 of the second latch body 231. The plate 237 may be provided to be elastically supported on the upper side of the guide 235. One side of the plate 237 may be fixed to the latch unit case 221 and the other side of the plate 237 may be provided to elastically press the upper portion of the guide 235 to the lower side.

The guide 235 may be moved to a first position P1 or a second position P2 of the rail groove 232 according to the forward and rearward movement of the second latch body 231.

The driving unit 250 configured to move the guide 235 may include a motor 251, first gears 252*a* and 252*b* connected to a rotation shaft 251*a* of the motor 251, and a pusher 254 in which a second gear 253 engaged with the first gears 252*a* and 252*b* is formed.

The pusher 254 may be engaged with the first gears 252*a* and 252*b* and convert a rotational motion of the motor 251 and the rotation shaft 251*a* into a linear motion so as to press and move the guide 235.

The pusher 254 may be provided in a substantially bar shape. The pusher 254 may include the second gear 253 to be connected to the first gears 252*a* and 252*b* connected to the rotation shaft 251*a* of the motor 251. The second gear 253 may be provided on a part of a lower surface of the pusher 254. The second gear 253 may be formed to have a predetermined length on one side of the lower surface of the pusher 254. In response to the rotation of the motor 251 by the second gear 253, the first gears 252*a* and 252*b* connected to the rotation shaft 251*a* may be rotated and the second gear 253 engaged with the first gears 252*a* and 252*b* may be moved in a straight line. The pusher 254 moved linearly by the second gear 253 may be provided with a pressing surface 255 pressing the guide 235 to move the guide 235. The pressing surface 255 may be provided at an end of the pusher 254. The pressing surface 255 may be provided at a position opposite to the second gear 253 of the pusher 254. The pusher 254 may be arranged horizontally with the guide 235. Particularly, the pressing surface 255 of the pusher 254 may be positioned on the same line as the guide 235 and thus the first end 235*a* of the guide 235 may be moved along the rail groove 232 by the linear movement of the pusher 254.

The first end 235*a* of the guide 235 may be movably connected to the rail groove 232 of the second latch body 231. The rail groove 232 of the second latch body 231 may include a first path 232*a* and a second path 232*b*. The first path 232*a* and the second path 232*b* may be formed symmetrically to each other.

In response to the closed state of the detergent container 110 and the detergent container housing 120 by the latch device 200, the first latch member 210 arranged in the detergent container 110 may be locked to the second latch member 220 of the detergent container housing 120.

Particularly, the locking hole 212 of the first latch body 211 is in a locked state by the latch 233 of the second latch body 231. In the second latch body 231, the first end 235*a* of the guide 235 may be positioned in the first groove 236*a* of the rail groove 232, and the first end 235*a* of the guide 235 may be positioned in the position P1.

When the controller 50 controls the latch device 200 so as to open the detergent container 110 from the detergent container housing 120, the motor 251 of the second latch member 220 is operated.

In response to the rotation of the rotation shaft 251*a* of the motor 251, the first gears 252*a* and 252*b* connected to the rotation shaft 251*a* may be rotated, and the second gear 253 engaged with the first gears 252*a* and 252*b* may be moved to move the first end 235*a* of the guide 235. The second latch body 231 may be moved forward by the elastic member 238, and the first end 235*a* of the guide 235 may be positioned at the second groove 236*b* through the first path 232*a*. The first end 235*a* of the guide 235 may be positioned at the second position P2.

As the second latch body 231 is moved forward, the latch 233 may be rotated downward, and accordingly, the locking hole 212 of the first latch member 210 may be unlocked from the latch 233.

In response to the release of the connection between the locking hole 212 of the first latch member 210 and the latch 233, the detergent container 110 may be opened from the detergent container housing 120 while being moved forward of the washing machine 1.

The detergent container 110 is accommodated in the detergent container box 101 and slidably mounted on the detergent container housing 120.

The guide rib 130 provided to guide the detergent container 110 to slide may be provided on the lower surface 120*b* and both side surfaces 120*c* of the detergent container housing 120. The guide rib 130 may include the second guide rib 132 formed on the lower surface 120*b* of the detergent container housing 120 and a guide side rib 132*a* formed on the both side surfaces 120*c* of the detergent container housing 120.

The second guide rib 132 and the guide side rib 132*a* of the detergent container housing 120 may be provided to be inclined downwardly forward. The second guide rib 132 and the guide side rib 132*a* of the detergent container housing 120 may be provided at an angle 8. The detergent container 110 may slide forward by an inclination of the second guide rib 132 and the guide side rib 132*a* of the detergent container housing 120. In response to the release of the latch device 200 between the detergent container housing 120 and the detergent container 110, the detergent container 110 may slide forward by the inclination of the second guide rib 132 and the guide side rib 132*a* formed in the detergent container housing 120 and by a weight of the detergent container 110, and thus the detergent container 110 may be opened from the detergent container housing 120.

The detergent container 110 may be provided with the first guide rib 131 formed to correspond to the second guide rib 132 and the guide side rib 132*a* of the detergent container housing 120. The first guide rib 131 may be provided on the detergent container box lower surface 101*d* of the detergent container 110.

A stopper 133 may be further provided between the detergent container 110 and the detergent container housing 120 to limit a sliding movement of the detergent container 110. The stopper 133 may include a first stopper 133*a* provided in the detergent container 110 and a second stopper 133*b* provided in the detergent container housing 120 to correspond to the first stopper 133*a*. The second stopper 133*b* may be positioned at an end of the guide side rib 132*a* of the detergent container housing 120. The first stopper 133*a* may be positioned at a corner between the detergent container box rear surface 101*b* and the detergent container box side surface 101*c* to correspond to the second stopper 133*b*. According to an embodiment, the stopper is illustrated as being positioned on the guide side rib of the detergent container housing and the detergent container box side surface, but is not limited thereto. For example, the position of the stopper may vary.

Figure 13:
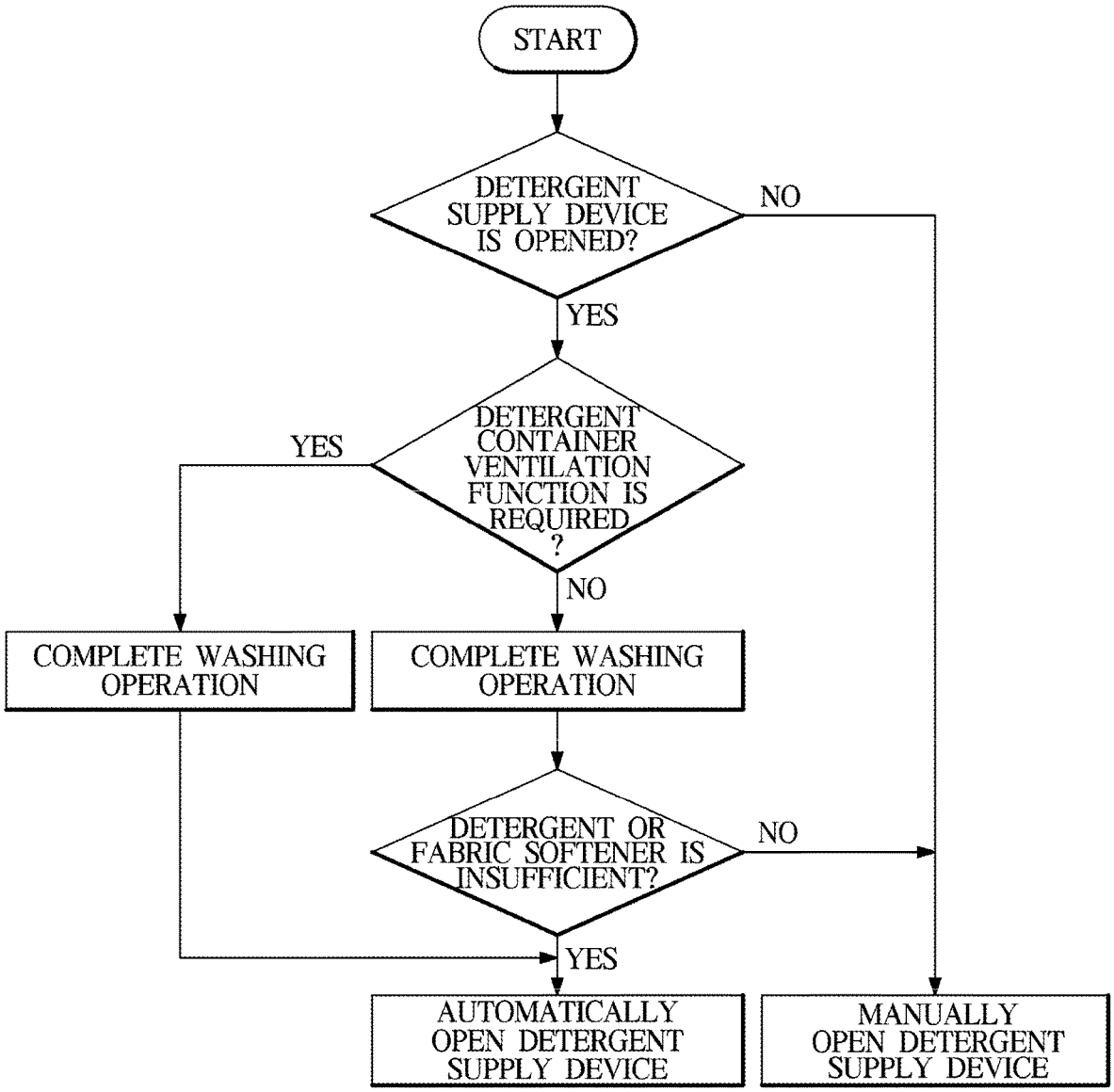
FIG. 13 is a control block diagram illustrating a washing machine according to an embodiment of the disclosure.
Figure 14:
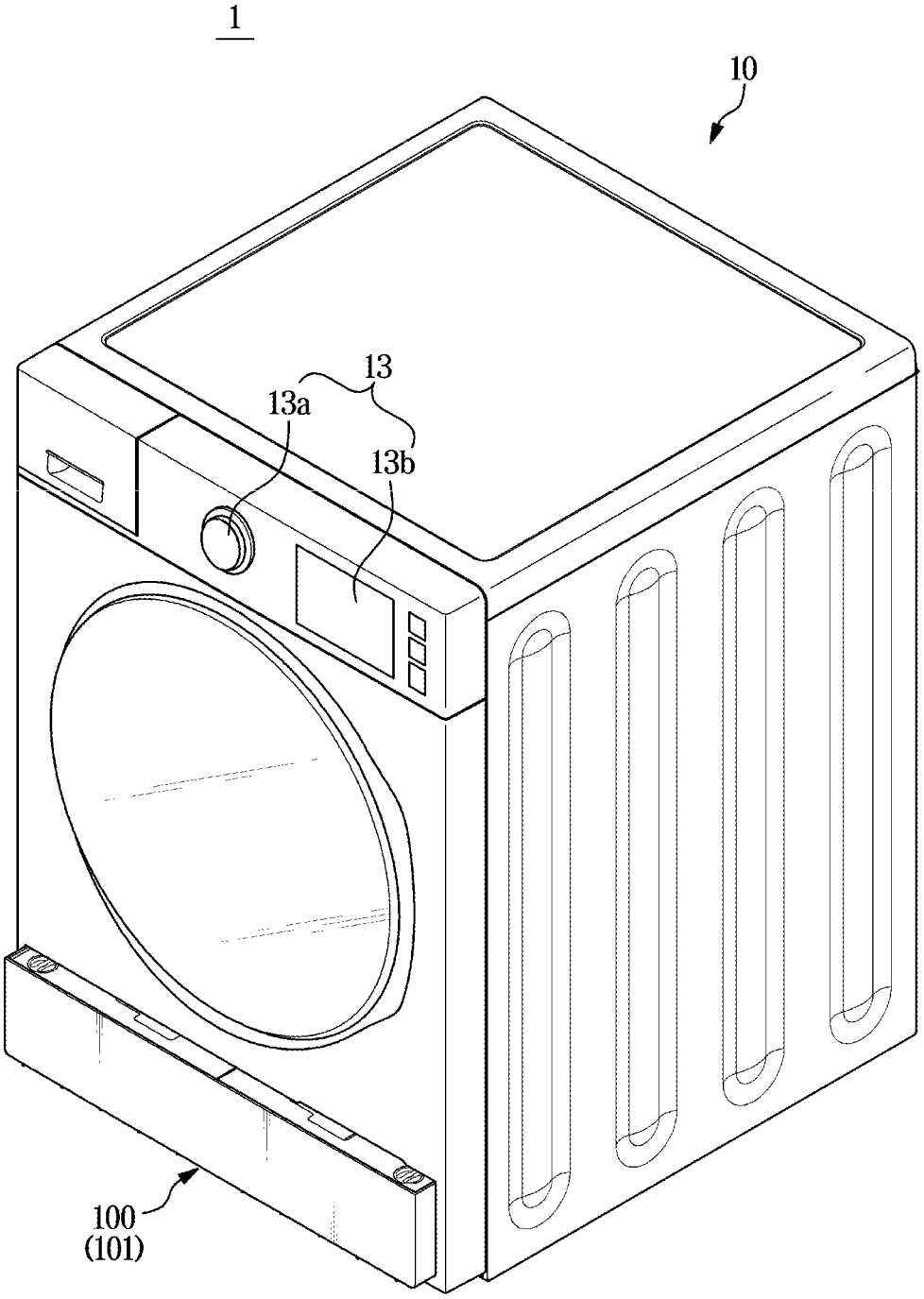
FIG. 14 is a view illustrating a state in which the detergent container is drawn out from a detergent container housing of the detergent supply device shown in FIG. 2 according to an embodiment of the disclosure.
Figure 15:
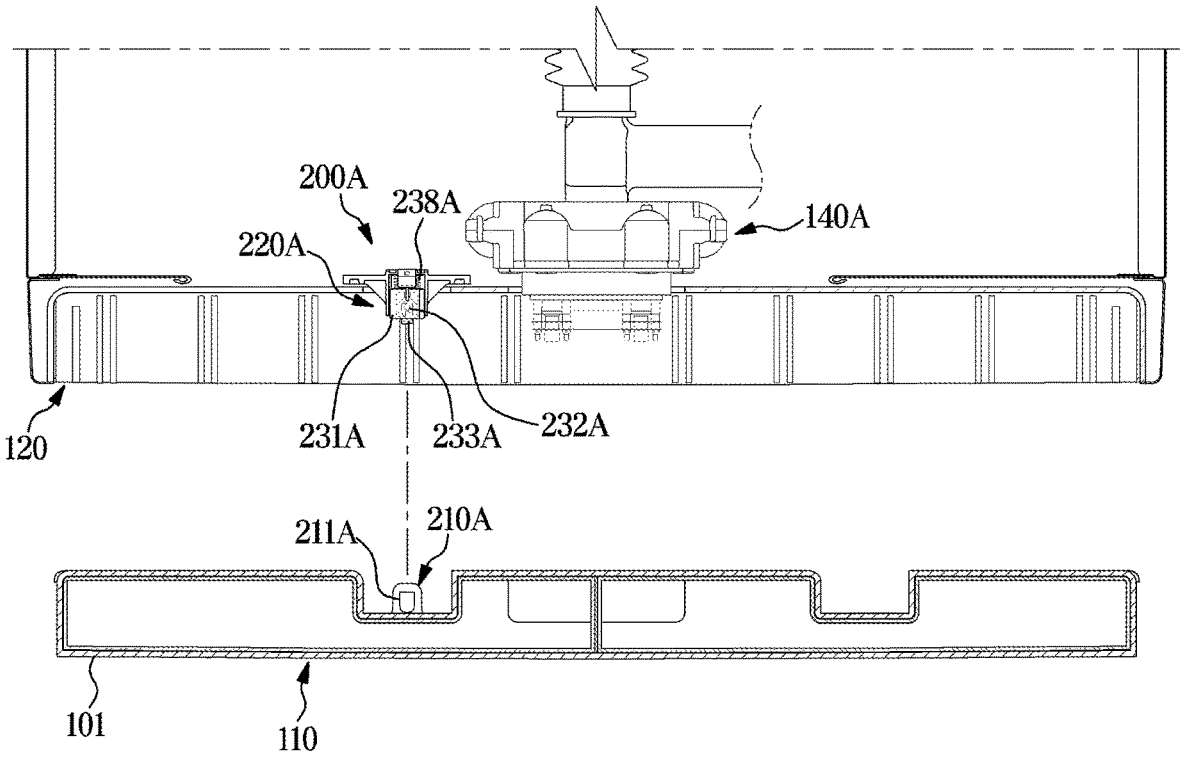
FIG. 15 is a view illustrating a state in which the detergent container is opened in the detergent supply device of the clothes treating apparatus according to an embodiment of the disclosure.
Figure 16:
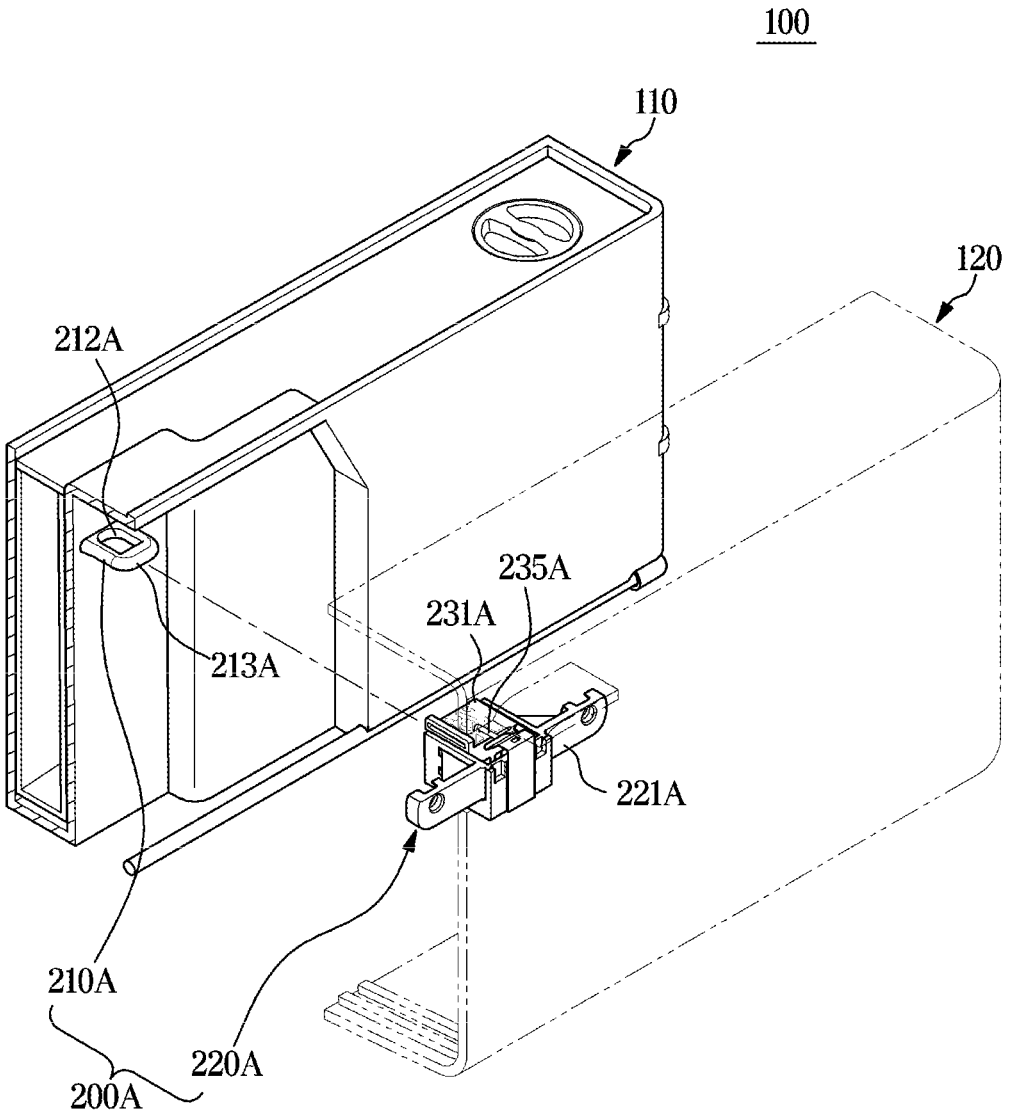
FIG. 16 is a view illustrating a state in which the latch device is mounted to the detergent supply device in the clothes treating apparatus shown in FIG. 14 according to an embodiment of the disclosure.

FIG. 13 is a control block diagram illustrating a washing machine according to an embodiment of the disclosure. FIG. 14 is a view illustrating a state in which the detergent container is drawn out from a detergent container housing of the detergent supply device shown in FIG. 2. FIG. 15 is a view illustrating a state in which the detergent container is opened in the detergent supply device of the clothes treating apparatus according to an embodiment of the disclosure. FIG. 16 is a view illustrating a state in which the latch device is mounted to the detergent supply device in the clothes treating apparatus shown in FIG. 14. Hereinafter descriptions of parts the same as the above description will be omitted.

FIG. 13 illustrates that the detergent container 110 of the washing machine 1 is in an open state. A user may select a detergent supply device automatic open mode in the washing machine 1. In response to the detergent supply device automatic open mode selected by a user through the control panel 13, a corresponding control signal may be transmitted to the controller 50.

In response to the reception of the detergent supply device automatic open mode, the controller 50 may determine whether the detergent container 110 needs a ventilation function. For example, the controller 50 may perform the determination by detecting the open/closed state of the detergent container 110 through the second sensor 62 provided in the detergent container 110 and the detergent container housing 120. Further, the controller 50 may determine whether the detergent container 110 has been closed in the detergent container housing 120 for a long time. In response to the detection of the closed state of the detergent container 110 through the second sensor 62, the controller 50 may control a latch device 200 to open the detergent container 110 of the detergent supply device 100.

The detergent supply device automatic open mode may be provided to automatically open the detergent container 110 of the detergent supply device 100 from the detergent container housing 120 by controlling the latch device 200 according to a control signal.

In the automatic open mode of the detergent supply device 100, the detergent container 110 may be moved to the front of the washing machine 1 and thus a consumer can intuitively recognize the open state of the detergent container 110. Accordingly, the user can easily recognize the need to replenish the detergent, and the ventilation of the inside of the detergent container 110 may be smoothly performed, thereby preventing the growth of mold.

In addition, the user may control the latch device 200 of the detergent supply device 100 even when the detergent supply device automatic open mode is turned off.

As illustrated in FIGS. 13 to 16, the user may manually open the detergent container 110 of the washing machine 1.

The detergent container 110 may be locked or unlocked through the detergent container housing 120 and the latch device 200.

The user may manually open the detergent container 110. The latch device 200 may include a first latch member 210A and a second latch member 220A.

The first latch member 210A may include a first latch body 211A in which a locking hole 212A is formed to be locked to or unlocked from at least a portion of the second latch member 220A, and a pressing member 213A formed in the first latch body 211A and in contact with at least a portion of the second latch member 220A.

The second latch member 220A may be provided in the detergent container housing 120. The second latch member 220A may be arranged at a position corresponding to the first latch member 210A. The second latch member 220A may include a latch 233A provided to lock or unlock the locking hole 212A of the first latch member 210A.

The second latch member 220A may include a second latch body 231A provided to be moved back and forth inside a latch unit case 221A, an elastic member 238A elastically supporting between the second latch body 231A and the latch unit cases 221A to allow the second latch body 231A to be moved back and forth, and a guide 235A provided to guide the movement of the second latch body 231A.

A rail groove 232A forming a movement path of the guide 235A may be provided in the second latch body 231A. The guide 235A may be coupled to the rail groove 232A.

Specific structures of the first latch member 210A and the second latch member 220A of the latch device 200 are the same as described above.

In response to the closed state of the detergent container 110, the locking hole 212A of the first latch member 210A is locked by the latch 233A. At this time, the elastic member 238A of the second latch member 220A is in a compressed state, and a first end 235*a* of the guide 235A may be positioned at a first groove 236*a* of the rail groove 232A of the second latch body 231A. The guide 235A is in a fixed state to prevent the movement of the second latch body 231A.

In response to the detergent container 110 being pushed by the user, the first latch member 210A may move the second latch body 231A to the rear side, and the elastic member 238A may be further compressed. Accordingly, the first end 235*a* of the guide 235A may be moved to a second groove 236*b* of the rail groove 232A. As the first end 235*a* of the guide 235A is moved to the second groove 236*b* of the rail groove 232A, the compression of the elastic member 238A may be released and the second latch body 231A may be moved forward and the latch 233A may be rotated downward to release the locking with the locking hole 212A of the first latch member 210A. In response to the unlocking of the first latch member 210A and the second latch member 220A, the detergent container 110 may be opened while being moved forward.

As is apparent from the above description, a clothes treating apparatus may increase a user convenience by allowing a user to recognize a lack of detergent in a detergent supply device or a completion of a washing operation.

Further, a clothes treating apparatus may prevent contamination and growth of mold by performing ventilation in a detergent supply device.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes treating apparatus, comprising:

a main body;

a tub arranged inside the main body;

a detergent container configured to store detergent;

a detergent container housing configured to accommodate the detergent container;

a pump connected to the detergent container housing so as to discharge the detergent stored in the detergent container;

a latch device configured to detachably connect the detergent container to the detergent container housing so as to close the detergent container, and to disconnect the detergent container from the detergent container housing so as to open the detergent container; and a controller configured to control the latch device to disconnect the detergent container from the detergent container housing so as to open the detergent container in response to a lack of detergent in the detergent container upon completion of a washing operation, wherein the detergent container housing is configured with a lower surface that is inclined downwardly forward so that the detergent container slides forward along the lower surface when the detergent container is disconnected from the detergent container housing by the latch device.

2. The clothes treating apparatus of claim 1, further comprising:

a sensor configured to detect a remaining amount of detergent or fabric softener in the detergent container, wherein the controller is configured to control the latch device to disconnect the detergent container from the detergent container housing so as to open the detergent container in response to the sensor detecting the lack of the detergent or fabric softener.

3. The clothes treating apparatus of claim 1, further comprising:

a sensor configured to detect an open and closed state of the detergent container, wherein the controller is configured to control the latch device to disconnect the detergent container from the detergent container housing so as to open the detergent container in response to the sensor detecting a closed state of the detergent container upon the completion of the washing operation.

4. The clothes treating apparatus of claim 1, wherein, the latch device includes:

a first latch member arranged on the detergent container; and a second latch member arranged in the detergent container housing, wherein the second latch member is configured to lock the first latch member to, and unlock the first latch member from, the second latch member.

5. The clothes treating apparatus of claim 4, wherein, the first latch member includes:

a first latch body in which a locking hole is formed to be locked to, and unlocked from, at least a part of the second latch member.

6. The clothes treating apparatus of claim 5, wherein, the first latch body includes:

a pressing member configured to be in contact with at least a part of the second latch member.

7. The clothes treating apparatus of claim 5, wherein, the second latch member includes:

a latch unit including a latch configured to:

be moved to lock the locking hole to lock the first latch member to the second latch member, and be moved to unlock the locking hole to unlock the first latch member from the second latch member; and a driving unit configured to move the latch.

8. The clothes treating apparatus of claim 7, wherein, the latch unit includes:

a latch unit case;

a second latch body configured to be moved back and forth inside the latch unit case;

an elastic member arranged between the second latch body and the latch unit case and configured to elastically support the second latch body to be movable back and forth; and a guide provided to guide movement of the second latch body, wherein the latch is rotatably coupled to the second latch body.

9. The clothes treating apparatus of claim 8, wherein, the second latch body includes:

a rail groove forming a movement path of the guide, wherein the guide is coupled to the rail groove.

10. The clothes treating apparatus of claim 9, wherein, the second latch member further includes:

a plate provided to elastically press the guide to be moved along the rail groove in response to back and forth movement of the second latch body.

11. The clothes treating apparatus of claim 8, wherein, the driving unit includes:

a motor including a rotation shaft;

a gear connected to the rotation shaft of the motor; and a pusher engaged with the gear and configured to convert a rotational motion into a linear motion so as to press and move at least a part of the guide.

12. The clothes treating apparatus of claim 11, wherein, the pusher is arranged horizontally with the guide.

* * * * *